US008646974B2

(12) United States Patent
Dalgleish et al.

(10) Patent No.: US 8,646,974 B2
(45) Date of Patent: Feb. 11, 2014

(54) BULK PACKAGING MULTI-WALL SACK AND APPARATUS FOR MANUFACTURING THE SACK

(75) Inventors: Adrian Dalgleish, Whittlesea (AU); Larry Thomas Challis, Eden Park (AU)

(73) Assignee: Amcor Limited, Victoria (AU)

( * ) Notice: Subject to any disclaimer, the term of this patent is extended or adjusted under 35 U.S.C. 154(b) by 1694 days.

(21) Appl. No.: 10/582,017

(22) PCT Filed: Dec. 9, 2004

(86) PCT No.: PCT/AU2004/001727

§ 371 (c)(1),
(2), (4) Date: Jan. 24, 2007

(87) PCT Pub. No.: WO2005/056404

PCT Pub. Date: Jun. 23, 2005

(65) Prior Publication Data

US 2007/0140599 A1 Jun. 21, 2007

(30) Foreign Application Priority Data

Dec. 9, 2003 (AU) ..... 2003906845

(51) Int. Cl.
*B65D 30/12* (2006.01)

(52) U.S. Cl.
USPC ..... 383/125; 383/111; 383/84; 383/88; 383/109

(58) Field of Classification Search
USPC ..... 383/84, 109, 113, 114, 88–91, 111, 383/125, 126, 85
See application file for complete search history.

(56) References Cited

U.S. PATENT DOCUMENTS

| | | | | |
|---|---|---|---|---|
| 2,522,200 | A * | 9/1950 | Southwick, Jr. | 53/449 |
| 3,190,441 | A * | 6/1965 | Rausing | 206/525 |
| 3,988,873 | A * | 11/1976 | Oliverius | 53/449 |
| 4,088,264 | A | 5/1978 | Vogt | |
| 5,007,233 | A | 4/1991 | Bose | |
| 5,350,239 | A * | 9/1994 | Strand et al. | 383/7 |
| 5,403,096 | A * | 4/1995 | Aagesen | 383/111 |
| 5,836,444 | A * | 11/1998 | Hoevel et al. | 206/63.5 |
| 6,213,644 | B1 | 4/2001 | Henderson et al. | |
| 6,526,730 | B2 * | 3/2003 | Koehn | 53/479 |
| 6,536,190 | B1 * | 3/2003 | Webb et al. | 53/449 |

FOREIGN PATENT DOCUMENTS

| | | | |
|---|---|---|---|
| AU | 199746945 | B2 | 10/1997 |
| AU | 199910118 | B2 | 11/1998 |
| EP | 0869073 | B1 | 5/2001 |
| WO | WO 01/25102 | A1 | 4/2001 |

* cited by examiner

*Primary Examiner* — Nathan J Newhouse
*Assistant Examiner* — Peter Helvey
(74) *Attorney, Agent, or Firm* — Fitch Even Tabin & Flannery LLP

(57) ABSTRACT

An as-manufactured multi-wall sack that comprises an inner pouch 5 and an outer bag 7 is disclosed. The sack has a top end that (a) is open in the as-manufactured form of the sack so that the sack can be filled with product via the open end and (b) is formed so that it can be closed to form a top block end. The as-manufactured form of the sack comprises pressure adhesive that connects together the inner pouch and the outer bag at the open top end of the sack. The as-manufactured form of the sack also comprises heat-activated adhesive on sections of the outer bag that adhere to other sections of the outer bag as part of the sequence of steps to close the outer bag. An apparatus and a method for closing the as-manufactured sack are also disclosed.

9 Claims, 5 Drawing Sheets

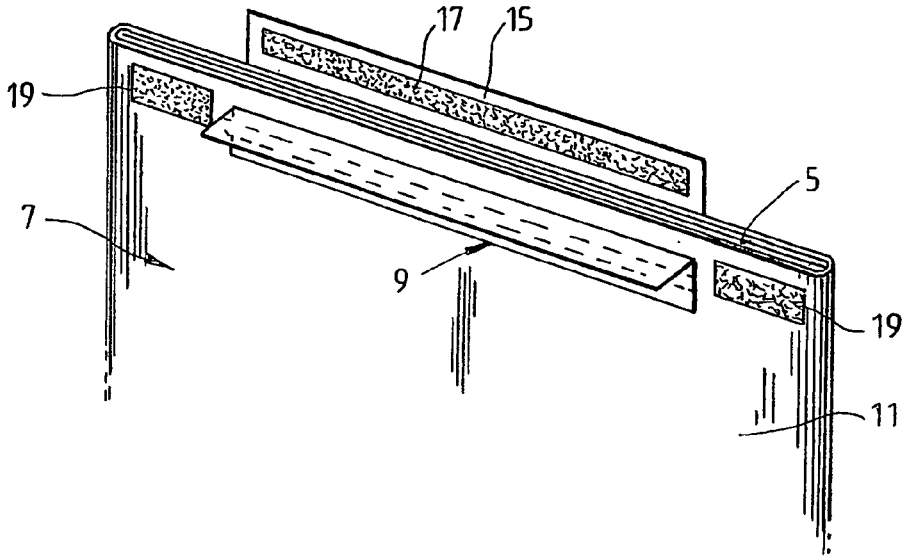
FIG. 6a
FIG. 6b
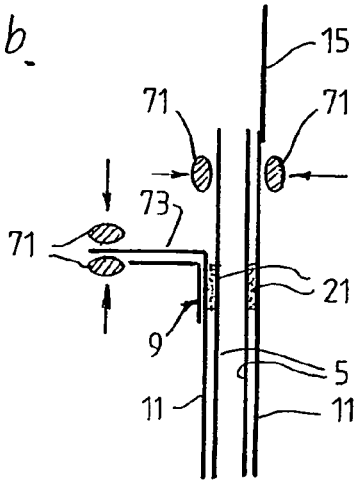

BULK PACKAGING MULTI-WALL SACK AND APPARATUS FOR MANUFACTURING THE SACK

This Application is the National Phase of International Application No. PCT/AU2004/001727 filed Dec. 9, 2004, which designated the U.S. and was published under PCT Article 21(2) in English, and this application claims, via the aforesaid International Application, the foreign priority benefit of and claims the priority from Australian Application No. 2003906845, filed Dec. 9, 2003, the complete disclosures of which are incorporated herein by reference.

The present invention relates to sacks that are often used for bulk packaging of products and to an apparatus for forming a top block end on the sacks after the sacks have been filled with product.

Typically, bulk packaging sacks are understood herein to mean sacks that are used to package 20 kg plus amounts of products.

The present invention relates particularly, although by no means exclusively, to bulk packaging sacks that are in the form of multi-wall sacks of the type which comprise an outer bag, typically made from paper-based products, and an inner pouch, typically made from a polymeric material.

The present invention relates more particularly, although by no means exclusively, to bulk packaging sacks that are in the form of multi-wall sacks of the type described in the preceding paragraph which are suitable for bulk packaging of dried food products, such as powdered milk products.

The inner pouch of the above-described multi-wall sacks is provided for storing powdered milk products (and other dried food products) under sterile conditions. The outer bag shields the inner pouch from direct contact with potential sources of contamination while the multi-wall sacks are stored at an initial production and packaging site, transported to downstream processing sites, and stored at the processing sites prior to the packaged products being processed at the sites.

Australian patent 729303 in the name of the applicant discloses multi-wall sacks of the type described above and a method of forming a top block end on the sacks after the sacks have been filled with product. The sacks comprise an outer bag, typically made from paper-based products, and an inner pouch, typically made from a polymeric material. The sacks are characterized in that the sacks, when filled and closed, comprise a bottom block end and a top block end. The method comprises filling the inner pouch with product, such as dried powdered products, via an open top end of the sack, closing the inner pouch, and folding and gluing the outer bag at the open top end in a particular sequence of steps into a closed top block end.

Australian patent 760523 in the name of the applicant also discloses multi-wall sacks of the type described above that comprise an inner polymeric material pouch and an outer paper bag that are manufactured with an open top end through which product can be filled into the inner pouch and thereafter closed. The sacks are characterised in that the top end of the sacks is formed as an "easy" open end to facilitate access to the sealed inner pouch.

The disclosure in the above-described Australian patents is incorporated herein by cross reference.

The applicant has made improvements to the multi-wall sacks described in the Australian patents. The applicant has also developed an apparatus for sealing the sacks after the sacks have been filled with product and then folding the outer bag at the top end of the sack to form a top block end. The applicant has also realized that the apparatus, in a modified method of operation, can be used to form a top block end on other bulk packaging sacks, such as sacks that comprise outer bags but do not comprise inner pouches. The subject patent specification relates to the improvements.

Specifically, the applicant has developed a particular form of an as-manufactured multi-wall sack that has a closed bottom block end and can be filled and closed so that it has a closed top block end of the sacks of Australian patent 729303.

In addition, the applicant has developed a particular form of an as-manufactured multi-wall sack that has a closed bottom block end and can be filled and closed so that it has a closed top block end of the sacks of Australian patent 729303 and the "easy" open top end of the sacks of Australian patent 760523.

The applicant has also developed an apparatus and a method for forming a top block end on the above-described sacks after the sacks have been filled with product.

In general terms, the present invention provides an as-manufactured multi-wall sack that comprises an inner pouch, typically made from a polymeric material, and an outer bag, typically made from a paper-based material, with the sack having a top end that (a) is open in the as-manufactured form of the sack so that the sack can be filled with product via the open end and (b) is formed so that it can be closed to form a top block end.

Preferably the sack of the present invention has the following features, either separately or in combination.

1. In the as-manufactured form of the sack, the sack comprises pressure adhesive that connects together the inner pouch and the outer bag at the open top end of the sack. The amount and/or the type of adhesive is selected so that the adhesion of the inner pouch to the outer bag is greater on one of a front or a rear side of the sack than on the opposite side of the sack so that, as part of a sequence of steps to close the outer bag after a step of heat sealing the inner pouch closed, the front and rear sides of the outer bag can be folded outwardly with the sealed inner pouch being selectively detached from one of the sides of the outer bag and being retained by the other side. Retaining the sealed inner pouch on a selected one of the sides is important to the subsequent sequence of steps to close the outer bag. The decision to fold the front and rear sides outwardly as part of the sequence of steps to close the sack is advantageous in terms of downstream processing because it means that the sealed inner pouch is positioned on one of the sides and this frees up the other side and makes it possible for the other side to be a contact surface for adhering the outer bag in a closed position using heat-activated adhesive without having to be concerned about the impact of heat required to activate the adhesive on the polymeric material of the inner pouch. Other closing sequences would not have this advantage.

2. In the as-manufactured form of the sack, the sack comprises heat-activated adhesive on sections of the outer bag that adhere to other sections of the outer bag as part of the sequence of steps to close the outer bag. The heat activate adhesive may be the same adhesive on each section of the outer bag. The heat activated adhesive may be different adhesives on different sections of the outer bag. For example, in some situations it is preferable that the heat activated adhesive be different adhesives in terms of heat activation temperatures in different sections of the outer bag to minimize possible reactivation of adhesive during the steps to close the outer bag where these steps involve multiple applications of heat to the bag.

3. In the as-manufactured form of the sack, the positions of the sections of the outer bag that carry heat-activated adhesive are selected so that the sequence of steps to close the outer bag where possible positions the heat-activated adhesive sections so that the sections do not overlie the inner pouch. This ensures that the application of heat to activate the heat-activated adhesive does not damage the inner pouch.

The construction of the as-manufactured sack is determined by taking into account a number of factors that are relevant to forming a top block end on the sack after the sack has been filled with product. Preferably, the factors include one or more of the following factors:

(a) relative positions of the pressure and heat-activated adhesives on the outer bag in the as-manufactured form of the sack;

(b) the height of the upper end of the inner pouch in relation to the open top end of the sack and the positions of the pressure and heat activated adhesives; and (c) the requirements to form a block end on the filled and closed sack.

In relation to item c above, it is preferable that the sealed inner pouch be the same size or larger than the closed outer bag in order to facilitate proper formation of the block end.

The sack comprises an "easy" open feature on the outer bag that facilitates opening the outer bag after it has been closed.

According to the present invention there is also provided a filled and sealed bulk packaging sack formed by filling and closing the above-described as-manufactured multi-wall sack.

Preferably the bulk packaging sack also comprises a vent seal to allow air to escape from the inner pouch after the inner pouch has been closed.

Preferably the vent seal defines a tortuous flow path for air to escape from the closed inner pouch.

Preferably the bulk packaging sack also comprises product identification coding applied to the inner pouch after filling the as-manufactured multi-wall sack with product and prior to closing the outer bag.

Preferably the bulk packaging sack also comprises product identification coding on the outer bag.

According to the present invention there is also provided an apparatus for forming a top block end on the above-described as-manufactured multi-wall sack after the sack has been filled with product, which apparatus comprises:

(a) a means for supporting opposed front and rear sides of a filled sack having an open top end as the sack is moved between and operated on at the following stations;

(b) a first sealing station for bringing opposed sides of the open top end of the inner pouch into contact and heat sealing the opposed sides together and thereby closing the inner pouch;

(c) a first folding station for folding the opposed sides of the outer bag outwardly and forming out-turned sides and in-turned triangular wings, with the heat sealed inner pouch being retained by pressure adhesive to one side of the outer bag; and (d) a second sealing station for activating heat-activated adhesive along a section of an inner surface of one of the out-turned sides of the outer bag and thereafter folding the out-turned sides of the outer bag inwardly so that the adhesive-carrying inner side of the outer bag overlies and contacts an outer surface of the other side and the activated heat-sensitive adhesive adheres the folded sides together, with the inward folding of the out-turned sides causing sections of each in-turned wing to fold inwardly to overlie other sections of the wings;

(e) a third sealing station for activating heat-sensitive adhesive along sections of surfaces of the in-turned wings of the outer bag and thereafter adhering the overlying sections of the wings together to complete the sequence of steps to close the open top end of the sack.

Preferably the second sealing station includes two horizontally disposed plates on opposite sides of the sack, spaced away from the sack, that are adapted to move inwardly and outwardly to effect folding of the sides of the outer bag.

As is indicated above, the above-described apparatus, in a modified method of operation, can be used to form a top block end on other bulk packaging sacks, particularly as sacks that comprise outer bags but do not comprise inner pouches. Specifically, in this application, the modified method of operation is confined to carrying out the steps to fold and close the outer bag.

According to the present invention there is also provided a method for forming a top block end on the above-described as-manufactured multi-wall sack after the sack has been filled with product, which method comprises supporting and moving a field sack having an open top end through each of the above-described apparatus stations and operating the apparatus to seal the inner pouch and thereafter form a closed top end of the outer bag.

The present invention is described further with reference to the accompanying drawings, of which:

FIGS. 4, 5, 6A-B, 7A-C, 8A-B illustrate a number of subsequent folding operations at downstream stations of the apparatus for forming the top block end.

The sack shown in the Figures comprises an inner pouch 5, typically made from a polymeric material, and an outer bag generally identified by the numeral 7, typically made from a paper-based material.

The sack is manufactured with a top end that (a) is open in the as-manufactured form of the sack so that the sack can be filled with product via the open end (see FIG. 2), (b) has an "easy" open feature on the outer bag that facilitates opening the outer bag after it has been closed, and (c) and is formed so that it can be closed to form a block top end.

Figure 1:
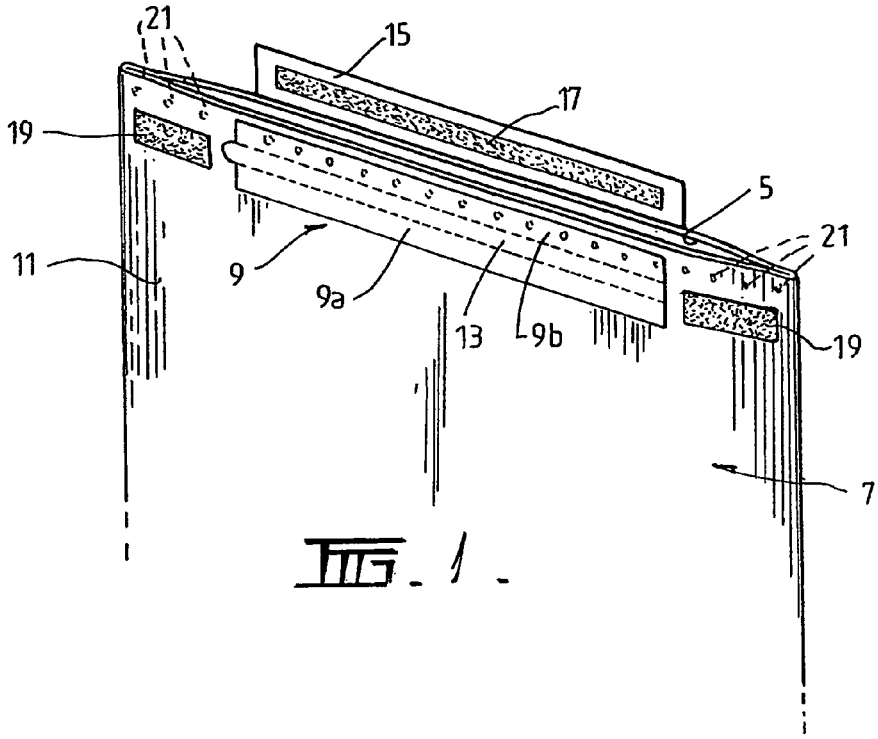
FIG. 1 illustrates an upper end of an as-manufactured sack in accordance with one embodiment of the present invention.

In the as-manufactured form shown in FIG. 1 the sack comprises a bottom block end (not shown) and opposed sides 11.

In addition, the sack includes lines of dabs 21 of pressure sensitive adhesive that adhere together the upper sections of the outer bag 7 and the inner pouch 5 on each side of the sack.

As is described in more detail hereinafter, preferably the amount and/or the type of adhesive is selected so that the adhesion of the inner pouch 5 to the outer bag 7 is greater on one side of the sack than on the other side of the sack.

The easy-open end is of the type disclosed in Australian patent 760523 and comprises a cover sheet generally identified by the numeral 9 that is attached to the side 11 of the outer bag 7 that is shown in FIG. 1.

The cover sheet 9 comprises a tear strip 13 and a first cover sheet section 9*a* and a second cover sheet section 9*b* that are separated by the tear strip 13. The first cover sheet section 9*a* is adhered to the side 11 of the outer bag 7.

The other side of the outer bag 11 of the as-manufactured sack comprises an upstanding top flap 15 and a strip 17 of hot melt adhesive on an inner surface of the flap 15.

As is described hereinafter, when the open end of the sack is folded to form a closed top block end, the top flap 15 overlies and is adhered to the second cover sheet 9*b*. In this position, the closed top block end can be opened by tearing the tear strip 13 to separate the first and second cover sections 9*a*, 9*b*.

The as-manufactured sack also comprises two other hot melt adhesive strips 19 positioned on each side 11 of the outer bag 11 shown in FIG. 1. Ultimately, as is described hereinafter, the strips contribute to adhering the folded sides of the sack in a top block end configuration.

The hot melt adhesive of the strips 19 is selected to have a lower activation temperature than that of the hot melt adhesive of the strip 17. The reason for the selection of different activation temperatures is to avoid reactivating already activated adhesives. Specifically, the folding steps position the strip 17 after it has been activated in relation to unactivated strips 19. The strips 19 are activated in a subsequent folding step to continue the process of forming the closed block end. It is important that this step of activating the strips 19 does not reactivate the strip 17 and thereby compromise the already-formed bond involving the strip 17.

The embodiment the apparatus for forming a top block end of a filled sack described above includes a plurality of stations in a line, as summarized below, a conveyer belt that extends along the line and is positioned so that sacks that have been filled with product at a filling station (not shown) can be moved along the line, and an upper guide that supports an upper section of each sack as the sack is moved along an upstream section of the line.

Figure 2:
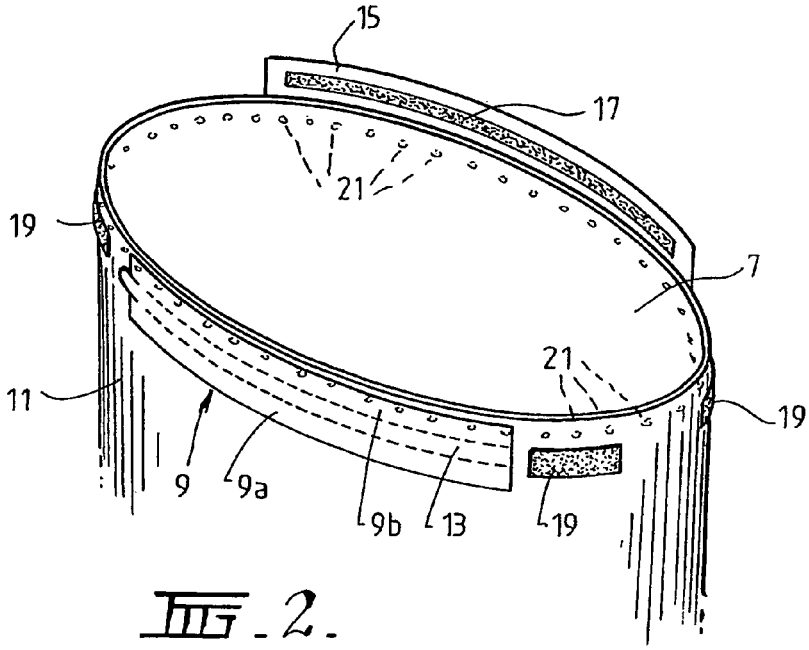
FIG. 2 illustrates the sack shown in FIG. 1 with the top end in an open position during a product filling operation.

FIG. 2 illustrates the sack in an open position at the filling station.

The stations are summarized below.

Figure 3:
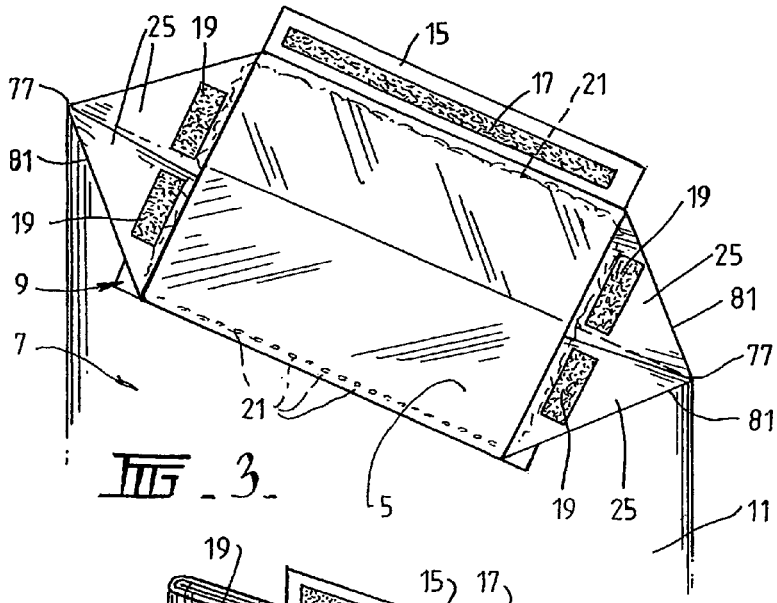
FIG. 3 illustrates the sack shown in FIGS. 1 and 2 in a partially folded position at one station of one embodiment of an apparatus for forming a top block end on the sack after the sack has been filled with product.
Figure 4:
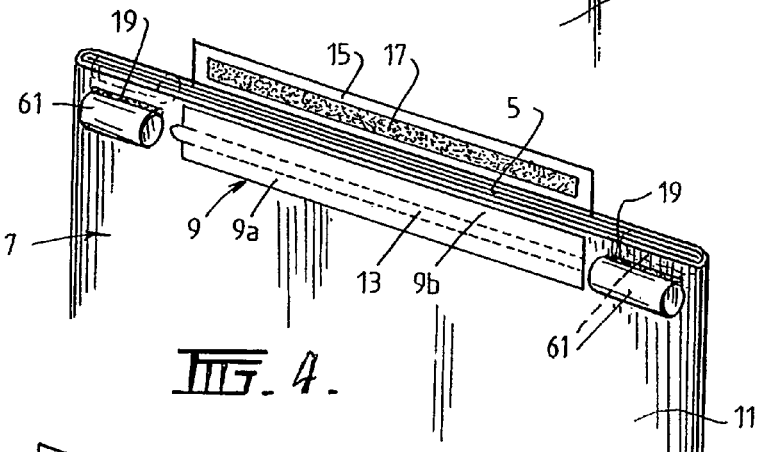
Figure 5:
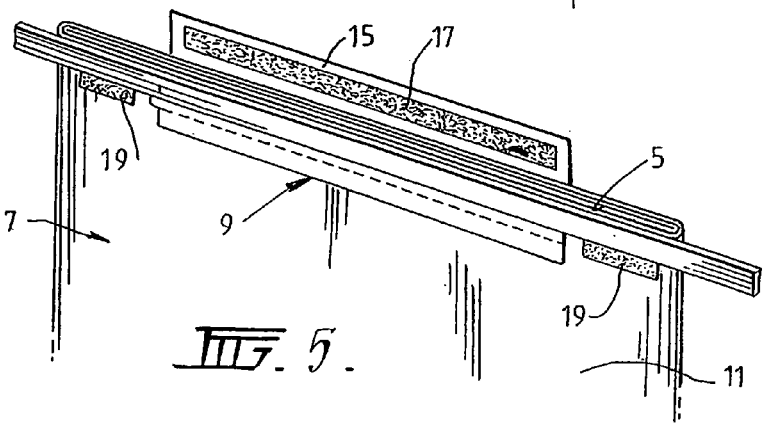
Figure 7A:
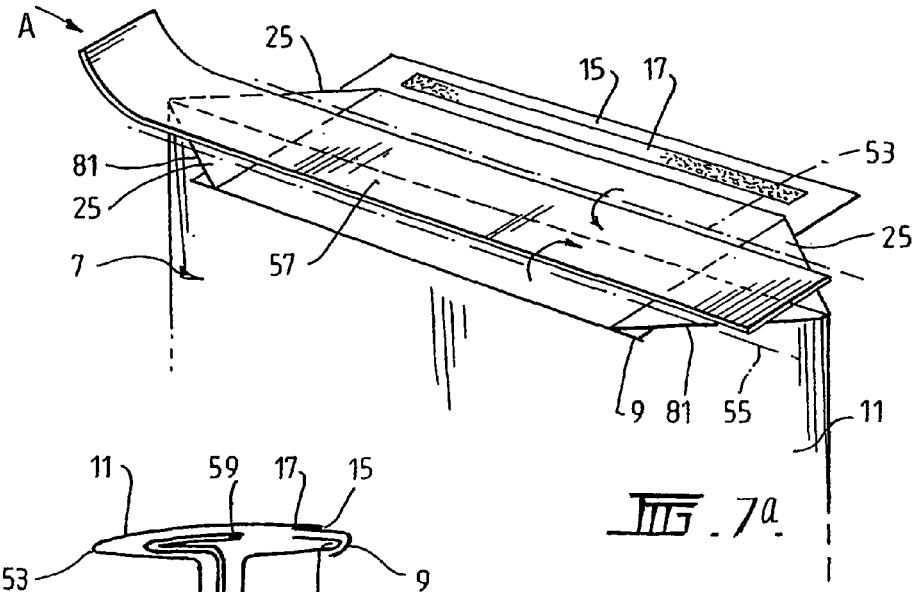
Figure 7B:
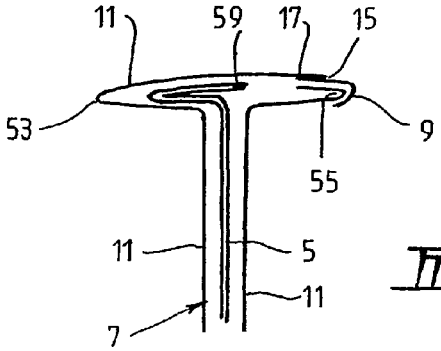
Figure 7C:
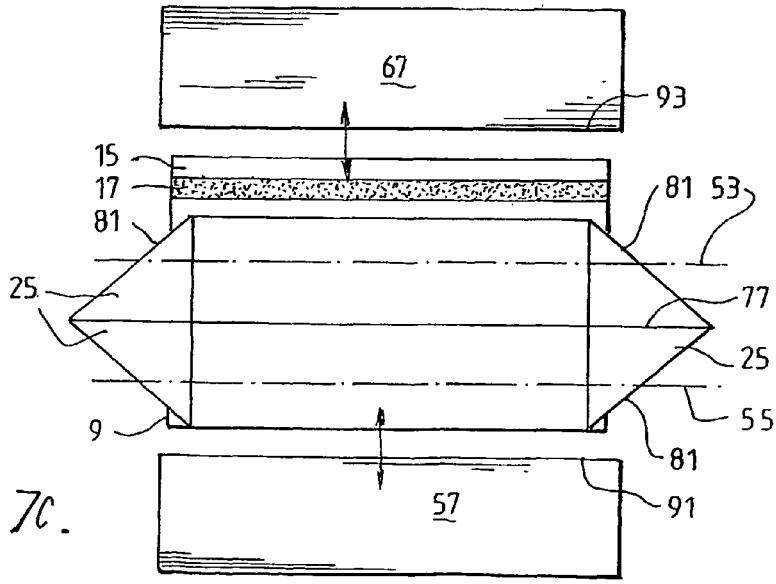
Figure 8A:
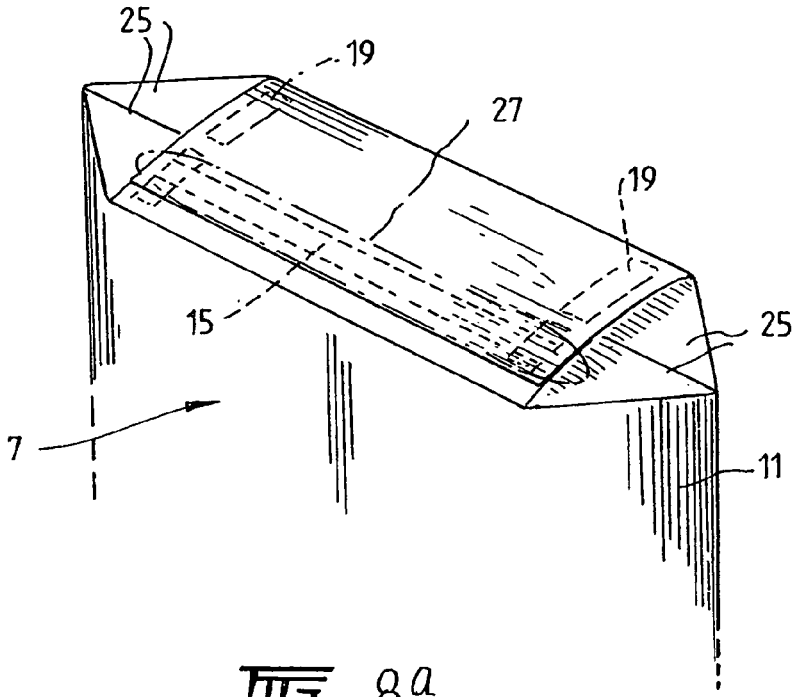
Figure 8B:
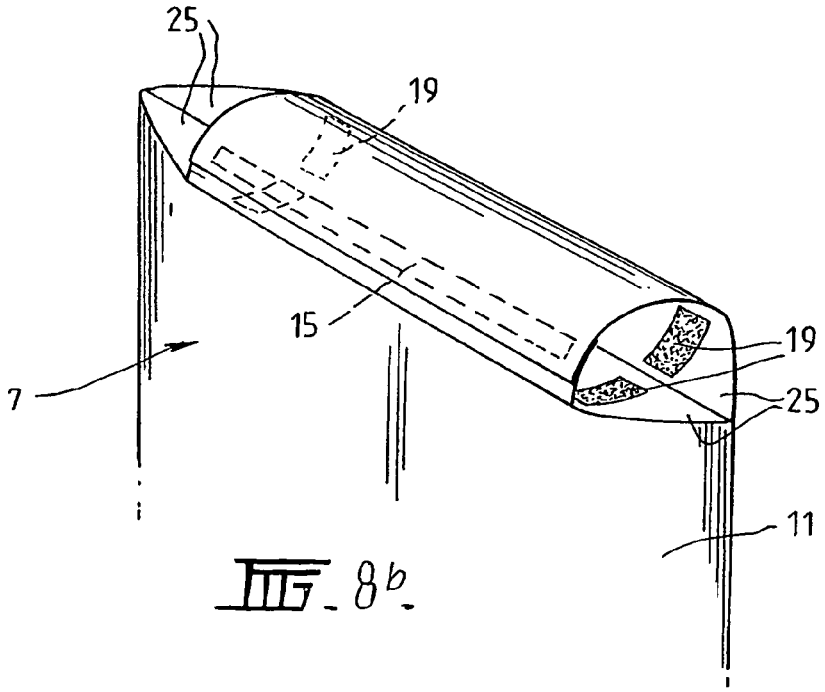

1. Initial contact station. Assemblies contact opposite sides of an open sack and press the sides together along a line of contact and support the sides in this position along the remainder of the line. FIG. 1 illustrates the sack at this point on the line. The assemblies may include a means to adjust the vertical position of the sack. The vertical adjustment operation is illustrated in FIG. 4. In the arrangement shown in FIG. 4 the adjustment means includes rollers 61 that contact the sides 11 and drive the sack up or down, as required. The sack is moved forward from this station so that the upper section of the sack engages the upper guide.
2. First seal station. One or two heat seal bars press opposite sides of the sack together and heat seal the inner pouch 5. This is illustrated in FIG. 5. This station may be constructed to form a vent seal in the inner pouch 5.
3. First folding station.
   (a) Assemblies, for example in the form of suction cups, gripper bars or other means engage the pressed-together sides of the sack. The assemblies move the sides outwardly in opposite directions, with one "side" comprising one side 11 of the outer bag 7 and the other "side" comprising the sealed inner pouch 5 and the other side 11 of the outer bag 7, preferably adhered together (due to different glue properties and/or different amounts of the same glue). The assemblies move the sack sides 11 outwardly and downwardly away from a primary fold line 77 (FIG. 3) of the sack onto a horizontal support member (not shown). This movement causes inward folding of the "ends" of the sack that forms triangular wings 25 (FIGS. 3, 7 and 8) at the opposite ends of the sack. One example of a suitable assembly comprises suction cups (not shown) that swing inwardly from opposite sides 11 and engage the sides and swing outwardly a short distance to partially open the pressed-together sides, a pair of plates (not shown) that are hinged together at upper ends of the plates that moves downwardly into the open end and then swing outwardly and downwardly in opposite directions to fold the sides 11 onto the horizontal support member. With reference to FIG. 6, another example of a suitable assembly comprises two pairs of oppositely acting gripper bars 71, with each pair being arranged to grip one of the sides and move the sides outwardly and downwardly onto a horizontal support member. FIG. 6 also illustrates that the sack may be formed with an outwardly folding flap on the side of the outer bag that does not retain the inner pouch in order to facilitate the operation of the gripper bars.
   (b) Assemblies, for example in the form of a flat plate (not shown), move downwardly and contact the triangular wings 25 and press the triangular wings against the horizontal support member and thereby form fold lines 81 that define the wings 25 (FIGS. 3 and 7). FIG. 3 illustrates the upper end of the sack at this point in the line.
4. Second seal station:
   (a) A heated bar (not shown) activates heat-activated adhesive strip 17 on the top flap 15 of the side 11 of the outer bag 7.
   (b) Assemblies fold each out-folded side of the sack, including the sections of wings 25 on each side, inwardly in turn about selected fold lines 53, 55 so that one side overlaps the other side and so that the adhesive strip 17 on the top flap 15 is in the overlap region. Suitable assemblies are in the form of horizontally-disposed plates 57, 67 that move inwardly and outwardly to effect the sequential folding operation. FIG. 7*a* illustrates one folding plate 57. FIG. 7*b* illustrates the final position of the folded sides 11, as viewed in the direction of the arrow A in FIG. 7*a* when the folding steps have been completed. FIG. 7*c* illustrates the folding plates 57, 67 in top plan view in relation to the sack. FIG. 7*b* illustrates that in the final folded arrangement, the sides 11 are selectively folded so that the inner pouch 5 with its heat sealed end 59 is laterally displaced from the overlapping regions of the sides 11. This ensures that the heat required to activate the adhesive that adheres the sides 11 together does not affect the polymeric material of the inner pouch. The circled region 27 identifies the region of overlap in the Figure. It is evident from the circled region that the adhesive strip 17 adheres the top flap 15 and that side 11 of the sack to the cover sheet 9, and thereby to the other side 11 of the sack. FIG. 7*c* is a top plan view (in very schematic form as is the case with the other drawings) that illustrates the horizontally disposed plates 57, 67 on opposite sides of the sack, spaced away from the sack. The folding sequence includes a first step of moving the plate 67 inwardly from the position shown in the Figure so that the side edge 93 is on the fold line 55. While the plate 67 remains in this position, the plate 57 is moved horizontally inwardly and lifts and folds the side 11 of the sack that carries the cover sheet 9 inwardly about the fold line 55. At the end of its inward stroke the plate 57 overlies the plate 67, with the folded side 11 between the plates, and with the side edge 91 of the plate 57 on the fold line 53. Thereafter, the plate 67 is withdrawn to its side of the sack and is then moved back horizontally inwardly and picks up and folds the side 11 of the sack which carries top flap 15 and sensitive adhesive strip 17 about the fold line 53 onto the folded side 11 of the sack. The plate 57 is then withdrawn to its side of the sack.
   (c) A sealing bar (not shown) presses down on the folded sides in the region of the overlap and further activates the adhesive of the adhesive strip 17 so that the sides are adhered together. A cooling bar (not shown) then cools the activated adhesive to complete the seal.

5. Third seal station.

(a) Hot air blowers are inserted into the partially opened ends of the adhered together, overlapping sides of the sack and hot air activates heat-activated adhesive strips 19 that now are positioned in the folded state of the sack as part of the folded wings 25. FIG. 8 illustrates the adhesive strips 19 and the partially opened ends. It is noted that forming and folding the sack so that the side 11 of the sack that includes the top flap 15 and adhesive strip 17 is positioned on and adhered to the cover sheet 9 rather than to the folded wings 25 means that the blower can be inserted into open ends of the sack.

(b) Sealing plates contact and press the partially opened ends downwardly and adhere the folded wings 25 together, thereby completing the formation of the top block end.

The above-described apparatus is a particularly effective apparatus for forming a top block end of a filled sack of the type shown in FIGS. 1 to 3.

The as-manufactured sack is suitable to be marked with a product identification code on the inner pouch 5 after the sack has been filled with product. This is an important feature in terms of product tracking, particularly in situations in which the outer bag is also marked with a suitable product identification code. It is not possible to gain access to inner pouches of current known sacks and apparatus for closing filled sacks.

Many modifications may be made to the invention as described above without departing from the spirit and scope of the invention.

By way of example, whilst the embodiment of the as-manufactured sack described above includes an easy-open end, the present invention is not so limited and extends to sacks that do not include easy-open ends.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

The invention claimed is:

1. An as-manufactured multi-wall sack that comprises an inner pouch made from a polymeric material and an outer bag made from a paper-based material, with the sack having a top end that (a) is open in the as-manufactured form of the sack so that the sack can be filled with product via the open end and (b) is formed so that it can be closed to form a top block end, and wherein, in the as-manufactured form of the sack, the sack comprises pressure adhesive that connects together the inner pouch and the outer bag at the open top end of the sack, and wherein the amount and/or the type of pressure adhesive is selected so that the adhesion of the inner pouch to the outer bag is greater on one of a front or a rear side of the sack than on the opposite side of the sack so that, as part of a sequence of steps to close the outer bag after a step of heat sealing the inner pouch closed, the front and rear sides of the outer bag can each be folded outwardly in opposite directions with the sealed inner pouch being selectively detached from one of the sides of the outer bag and being retained by the other side and folding outwardly with that other side.

2. The sack defined in claim 1 wherein, in the as-manufactured form of the sack, the sack comprises heat-activated adhesive on sections of the outer bag that adhere to other sections of the outer bag as part of the sequence of steps to close the outer bag.

3. The sack defined in claim 2 wherein, in the as-manufactured form of the sack, the positions of the sections of the outer bag that carry heat-activated adhesive are selected so that the sequence of steps to close the outer bag where possible positions the heat-activated adhesive sections so that the sections do not overlie the inner pouch.

4. The sack defined in claim 1, wherein said sack further comprises an "easy" open feature on the outer bag that facilitates opening the outer bag after it has been closed.

5. A filled and sealed bulk packaging sack formed by filling and closing the as-manufactured multi-wall sack defined in claim 1 whereby the filled and sealed sack has a top block end with the front and rear sides of the outer bad folded outwardly in opposite directions with the sealed inner pouch detached from one of the sides of the outer bag and retained by the other side and folded outwardly with that other side.

6. The bulk packaging sack defined in claim 5, wherein said bulk packaging sack further comprises a vent seal to allow air to escape from the inner pouch after the inner pouch has been closed.

7. The bulk packaging sack defined in claim 6, wherein the vent seal defines a tortuous flow path for air to escape from the closed inner pouch.

8. The bulk packaging sack defined in claim 5, wherein said bulk packaging sack further comprises product identification coding applied to the inner pouch after filling the as-manufactured multi-wall sack with product and prior to closing the outer bag.

9. The bulk packaging sack defined in claim 8, wherein said bulk packaging sack further comprises product identification coding on the outer bag.

* * * * *